United States Patent [19]

Josephson

[11] 4,023,290

[45] May 17, 1977

[54] CHART DEVICE

[76] Inventor: Joseph P. Josephson, 1545 McGregor, Montreal, Quebec, Canada

[22] Filed: June 18, 1976

[21] Appl. No.: 697,388

Related U.S. Application Data

[63] Continuation-in-part of Ser. No. 541,566, Jan. 16, 1975, abandoned.

[30] Foreign Application Priority Data

Jan. 21, 1974 Canada ..... 190605

[52] U.S. Cl. ..... 40/125 F; 35/7 A; 40/142 A

[51] Int. Cl.[2] ..... G09F 7/04

[58] Field of Search ..... 40/142 A, 125 F, 125 R, 40/125 A; 35/7 A, 19 A, 62; 281/45 A; 402/503

[56] References Cited

UNITED STATES PATENTS

| | | | |
|---|---|---|---|
| 2,177,905 | 10/1939 | McKeehan | 40/142 A X |
| 2,693,370 | 11/1954 | Wheatley | 281/45 A X |
| 2,959,832 | 11/1960 | Baermann | 40/142 A X |
| 3,186,323 | 6/1965 | Niehaus | 35/7 A X |
| 3,228,133 | 1/1966 | Baermann | 40/142 A |
| 3,603,592 | 9/1971 | Bury | 35/62 X |
| 3,711,991 | 1/1973 | Orfei et al. | 35/19 A |
| 3,716,935 | 2/1973 | Friederichs | 40/142 A |
| 3,874,103 | 4/1975 | Muta | 40/142 A |
| 3,942,147 | 3/1976 | Josephson | 40/142 A X |

OTHER PUBLICATIONS

Charles Mayer Studios Inc., Rubber Magnet Brochure, 1960.

*Primary Examiner*—John F. Pitrelli
*Attorney, Agent, or Firm*—Robert J. Schaap; Ian Fincham

[57] ABSTRACT

The present application discloses display systems and devices using magnetic means for retaining a plurality of layers of material on a display board.

9 Claims, 11 Drawing Figures

CHART DEVICE

This application is a continuation-in-part of Ser. No. 541,566 filed Jan. 16, 1975, now abandoned.

This invention relates to display devices and more particularly, this invention relates to visual display devices having means for mounting and retaining one or more charts on a display board or any other suitable flat surface.

Visual display devices per se are old and well known in the art. They may comprise a cork panel upon which is mounted a sheet of material displaying the required information, the sheet of material being secured to the cork panel by means of tape, thumb tacks or the like. Alternatively, there may be employed a device commonly known as the "black board" upon which the desired information may be written, and when desired, the information displayed thereupon may be erased and new material written. The present invention particularly relates to a visual display device having means for mounting a sheet of material displaying background information thereupon, and having further means of superimposing additional material upon the background information.

A requirement for many uses is a device adapted to receive a piece of material containing background information such as charts, maps, or the like, and having means for displaying further information in a superimposed relationship to the original sheet of material containing the background information. A common prior art proposal to meet this requirement has employed the use of a board upon which is mounted a piece of material containing the background information and a further transparent sheet of material mounted over the original background information, the transparent overlay sheet being adapted to receive markings thereupon. Normally, these sheets are retained in place by mechanical attaching means such as tape, tacks, or the like. Naturally, after a period of time, these sheets become unusable due to their gradual destruction by the mechanical attaching means employed.

It is therefore an object of this invention to provide for a visual display device having means for retaining a plurality of sheets thereupon, these retaining means not destroying the integrity of the sheets.

A further object of this invention is the provision of a visual display device having a display board, at least a portion of which is of a magnetic material, permanently magnetic retaining means, at least one underlay sheet, and at least one overlay film, the magnetic retaining means adapted to retain the underlay sheet and overlay film in juxtaposition to the display board by magnetic force.

A still further object of this invention is the provision of a visual display device wherein the magnetic retaining means and the overlay film form an integral unit whereby they may be removed and replaced as one complete unit.

A still further object of the present invention is to provide a visual display device wherein magnetic retaining means are employed which have strong and weak lines of polarity, which retaining means are adapted to operate in conjunction with the magnetic material on the display board.

A further object of the present invention is to provide a visual display system of the type above-mentioned having selective erasability features.

Still further, it is an object of the present invention to provide a system and method for the layout of buildings and the like.

As used in the disclosure and the claims of this application, a material which is said to be permanently magnetic is one which retains its magnetism indefinitely — i.e., it exhibits magnetic properties even after the exciting force has been removed. A ferromagnetic material is that which is capable of being attracted by a permanently magnetic material. A nonmagnetic material is that which exhibits substantially no mutually attractive forces when in the presence of a permanently magnetic material. A magnetic material as used herein and as defined according to the Standard College Dictionary is (1) capable of exerting magnetic force (2) capable of being attracted by a magnet — in other words, a magnetic material may be either a ferromagnetic material or a permanently magnetic material.

Furthermore, reference herein will be made to a "board" upon which sheets of material and retaining means are placed. It is understood that any reasonably flat surface, be it part of a wall, partition, divider, plates, etc., may equally well be utilized.

Generally, the device of the present invention comprises a board, magnetic retaining means, an underlay sheet, and an overlay film, the board having a portion thereof of a magnetic material, the magnetic retaining means being of a permanently magnetic material and being adapted to hold the underlay sheet and overlay film in juxtaposition to the display board by magnetic forces.

In one aspect, the device of the present invention comprises a board and retaining means, the board having at least one major flat and planar face and having a major portion of a nonmagnetic material and a minor portion of a magnetic material, the retaining means comprising at least one piece of permanently magnetic material.

In a further aspect, the device of the present invention comprises a board and retaining means, the board having at least one flat and planar major face, and having at least a portion thereof of a ferromagnetic material, the retaining means comprising at least one piece of permanently magnetic material.

In greater detail, the board employed in the display device may have any dimensioning which is suitable for the end use, and may be varied by those skilled in the art. A conventional embodiment utilizes a board of a substantially rectangular configuration, however, other configurations such as circular, triangular, polygonal, etc., may equally well be used.

In one embodiment, the board is of a substantially rigid nature and may be adapted to be mountable on a supporting structure such as a wall, tripod or the like, or of course, the board may comprise a portion of the wall, divider, etc.

As discussed above, at least a portion of the board is formed of a magnetic material — i.e., ferromagnetic or permanently magnetic material. According to one aspect of the present invention, at least a portion of the board is of a ferromagnetic material. In this embodiment, the ferromagnetic material may form the entire board or alternatively, only portions of the board may be of the ferromagnetic material — e.g., iron, steel, etc. An advantage of the embodiment wherein only a portion of the board is of a ferromagnetic material is that a substantial weight reduction may be accomplished by using lightweight materials to form the balance of the board. This also permits a substantial cost reduction in the manufacture of the device.

The ferromagnetic material may form only a surface of the board and/or be located about the circumferential edges so as to cooperate with the magnetic retaining means to be discussed hereinafter.

In a further aspect, the board of the present invention may comprise a portion of permanently magnetic material. In this embodiment, the permanently magnetic material comprises a minor portion of the material of the board, the major portion of the board material being of a nonmagnetic nature. As discussed hereinabove, when permanently magnetic material is employed in the construction of the board, the permanently magnetic material is placed about the board in such a manner as to cooperate with the magnetic retaining means. Even further, in the preferred embodiment, the permanently magnetic material is located proximate to the circumferential edges of the board.

In the embodiment wherein the permanently magnetic material is placed proximate to the circumferential edges of the board, the permanently magnetic material may comprise at least one strip of material having north and south poles extending longitudinally along the strip.

In the embodiment wherein the magnetic material comprises only a portion of the board, it is preferred that the magnetic material form a flat and planar surface with the nonmagnetic material. This may be accomplished by having a channel or groove into which the magnetic material is inserted.

In one particular embodiment of the present invention, the display board comprises a layer of backing material such as masonite with a relatively thin layer of a ferromagnetic material placed thereover. Thus, the board is of a laminate structure and is adapted to operate in conjunction with the retaining means in a manner to be discussed hereinafter.

The retaining means according to the present invention comprises at least one piece of permanently magnetic material. Such material may be any suitable — e.g. the permanently magnetic material may comprise an impregnated resinous material by which a retaining means of a flexible nature is obtained.

The magnetic retaining means may take any configuration adapted to the configuration of the board and the end use. As it is conventional to employ a substantial rectangular board, and wherein the magnetic material of the board is located about the circumferential edges of said board, the magnetic retaining means are adapted to be placed thereabout. To this end, in the preferred embodiment, the magnetic retaining means would comprise at least one longitudinally extending strip adapted to act in a cooperative manner with the magnetic portion of the board. Where the magnetic material of the board extends about the circumferential edges, there may be employed one or more pieces of permanently magnetic retaining strips. Thus, in the case where a substantially rectangular board is used, the retaining means may either comprise a one-piece integral rectangular permanently magnetic piece adapted to be placed about the circumferential edges of said board, or a plurality of strips may be placed about the circumferential edges.

In one particular embodiment, the retaining means comprises one or more strips of a permanently magnetic material, the strips having a pair of opposed major faces. On a first one of the major faces, the permanently magnetic material comprises north and south poles extending longitudinally along the strip, the north and south poles being relatively strong compared to north and south poles extending longitudinally on the opposed face of the strip, the opposed face having poles of a relatively weak nature. In this embodiment, the force with which the retaining means are held may be varied for reasons which will become apparent hereinafter.

According to one further aspect of this invention, there may be provided for sheets of material which are adapted to display information and are adapted to be held on the flat and planar major face of the board by the magnetic retaining means. In a preferred embodiment, at least two such pieces of sheet material are employed. The first sheet, adapted to be placed in juxtaposition to the planar major face of the board, may have desired background material such as graphs, charts, maps, etc., marked thereupon. As it is placed in juxtaposition to the board, such a sheet may be termed an "underlay sheet."

The second sheet used in conjunction with the device of the present invention is placed on top of the underlay sheet and is of a substantially transparent nature; as such, it may be termed an "overlay film." Although many materials are well known to those skilled in the art, which can be utilized for the overlay film, it is preferred that the overlay film be of a polyester material. In this respect, it has been found that the polyester film possesses substantial "lay-flat" properties compared to films such as acetate.

Furthermore, the polyester film is eminently suitable for receiving markings thereon. In the preferred embodiment of the invention, the display system is utilized in conjunction with a plurality of marking devices giving rise to a selective erasability feature. Thus, at least three different types of markers may be employed with the system.

A first type of marker is known in the trade as "liquid chalk" or "dry white marker." Such a marking device is dry erasable in the manner of chalk on a blackboard. A second type of marking device is known in the trade as an "overhead projector type marker" and is of a "temporary" nature in that it is erasable with water. A third type of marker employed in such a system is also known as "an overhead projector type marker" and is often referred to as "semi-permanent;" such a marker is based on an oil solvent. It may be erased with a suitable solvent such as is, for example, marketed under the trademark of "Dual Purpose Cleaner."

Thus, employing the three different types of markers outlined above, many options are available for the use of the system. Thus, schematic drawings can be done showing basic components with the oil base marker and details can be marked in with the "temporary/chalk" markers and alterations can be made thereto without affecting the markings from the oil based marker.

Still further, the system is extremely useful in the art of layout planning. Thus, for example, the present tendency in this art is to prepare separate blueprints for all features employed in the design being prepared. If one wishes to design a factory or office, one drawing is prepared showing the electrical layout, a further drawing or blueprint showing the layout and positioning of desks, machines, etc., and further drawings relating to heating, air-conditioning, etc. Normally, these drawings go through many revisions before completion. With the present invention, an underlay sheet may show the basic structure of the area to be planned. Subsequent overlay films are placed on the underlay sheet showing the other features so that a composite may be obtained. Still further, the system offers great flexibility in that, for example, cutouts of a magnetic material representing the machines, desks, etc., may be placed on the overlay film and moved around until the desired layout is achieved. Markings can then be drawn on the overlay film showing the exact placement of the items and this film can then be passed through a reproduction machine. This obviates the necessity of a plurality of drafts and/or revisions to the plans, each requiring a new and separate drawing. Furthermore, the present trend is to use photography once the desired layout is achieved. With the present system, reproduction is simple and does not require the further time and/or expense.

Having thus generally described the invention, reference will be made to the accompanying drawings showing preferred embodiments, and in which.

Figures 1, 2, 3, 4, 5, 6, 7, 8, 9, 10, 11:
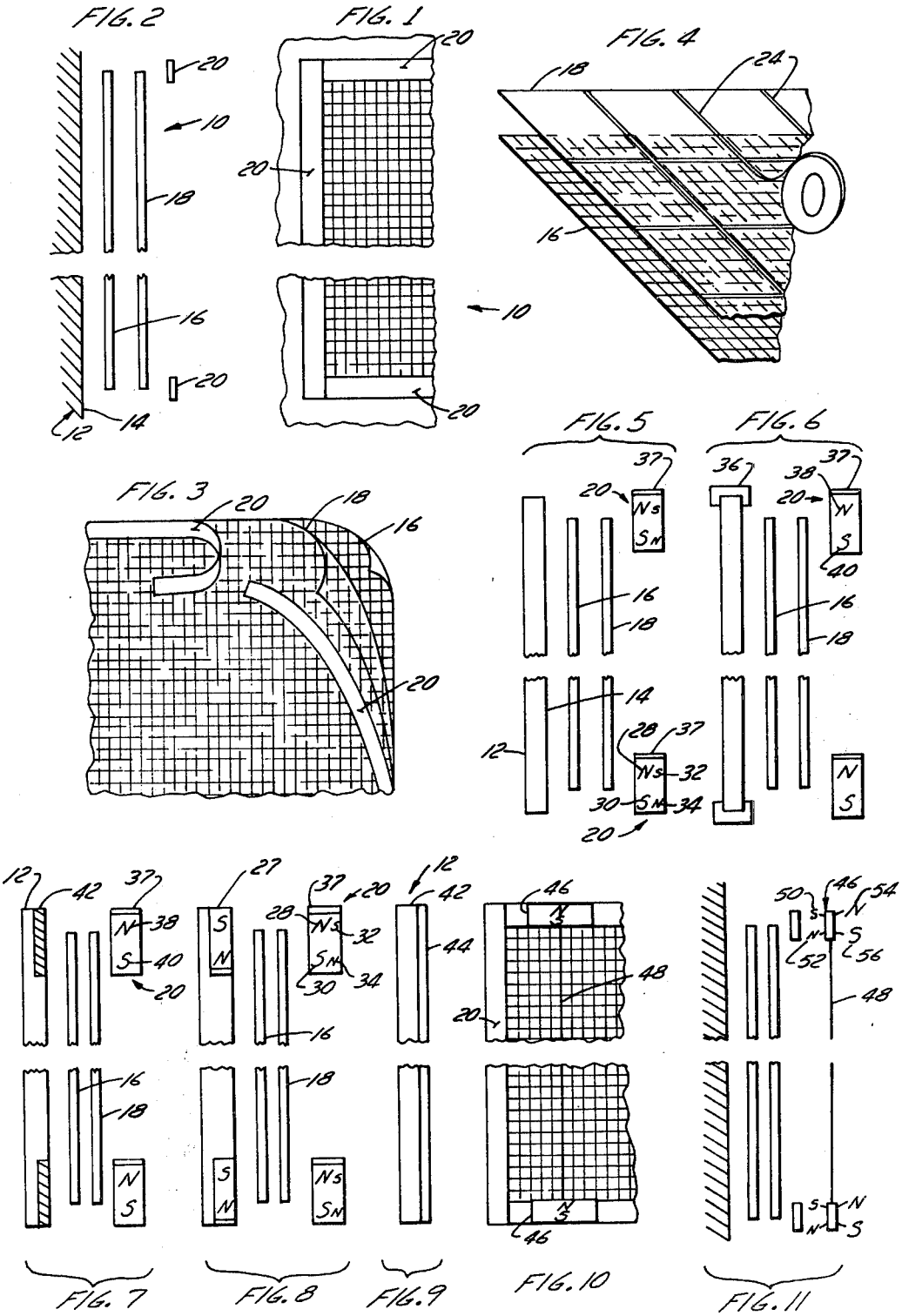
FIG. 1 is a plan view of a portion of the device of the present invention.
FIG. 2 is a cross-sectional view of FIG. 1.
FIGS. 3 and 4 are perspective views of the device of the present invention showing the assembly of the various components thereof.
FIGS. 5, 6, 7, 8 and 9 are cross-sectional views of embodiments of the present invention.
FIG. 10 is a plan view of a further embodiment according to the present invention.
FIG. 11 is a cross-sectional view of the embodiment of FIG. 10.

Referring now to the drawings, and in particular with respect to FIGS. 1 and 2, there is illustrated therein a visual display device designated generally by reference numeral 10. The visual display device 10 comprises a board 12, an underlay sheet 16, an overlay sheet 18 and magnetic retaining means 20.

Board 12 is of a substantially rectangular configuration, this being the most conventional, however, other configurations may equally well be employed. Board 12, in this embodiment, is of a ferromagnetic material such as steel, iron, alloys thereof, etc., and has a major face 14 which is of a substantially flat and planar nature. Board 12 may be mounted on a tripod or like supporting structure. Even further, board 12 may be a portion of a wall, divider, etc.

In FIG. 2, there is illustrated an underlay sheet 16 which is adapted to be placed in juxtaposition to surface 14 of board 12. In the plan view of FIG. 1, underlay sheet 16 has markings thereupon in the form of a gridwork. Other suitable markings or indicia such as graphs, charts, maps, etc., may be utilized. Underlay sheet 16 may be of a paper material, cardboard-like material, plastic film or the like, although it is preferred of a polyester material.

According to this invention, and as illustrated in FIG. 2, there is provided for an overlay film 18. This overlay film 18 is adapted to be placed on top of underlay sheet 16, and as such, is preferably of a substantially like size as underlay sheet 16. To permit visual access to underlay sheet 16, overlay film 18 is of a substantially transparent nature. Even further, according to one aspect of this invention, overlay film 18 is adapted to receive markings thereupon from a suitable marking device. Film 18 is preferably of a polyester material.

Retaining means 20 are adapted to hold underlay sheet 16 and overlay film 18 in juxtaposition to surface 14 of board 12. Retaining means 20 comprise strips of permanently magnetic material which will magnetically cooperate with the ferromagnetic material of board 12. At least a portion of the retaining strips 20 are placed on top of overlay film 18 to hold it securely to surface 14 of board 12. As shown, retaining means 20 comprise four rectangular strips of material adapted to be placed proximate to the circumferential edges of board 12. Alternatively, retaining means 20 could comprise smaller segments of permanently magnetic material adapted to be placed on overlay film 18. Still further, a one-piece substantially rectangular retaining means could be employed.

Referring to FIG. 3, there is shown therein a partial perspective view of the underlay sheet 16, overlay film 18 and magnetic retaining means 20 as they may be placed on the board. As illustrated, underlay sheet 16 and overlay film 18 are of substantially identical dimensions with overlay film 18 also serving as a protective covering for underlay sheet 16. In the embodiment illustrated, magnetic retaining means 20 are shown as being of a substantially flexible nature such as may be achieved by use of an impregnated resinous material.

FIG. 4 is illustrative of one type of underlay — in this case, a grid pattern and its method of manufacture. As shown, there is a pre-printed grid paper guide 16 positioned under the transparent film 18. Adhesive charting tapes 24 are positioned in place on the top side of the transparent film 18. Charting tapes are applied in predetermined positions using the pre-printing grid paper guide 16 as an aid. The transparent film 18 with charting tape grid pattern 24 now becomes one type of grid underlay. In this embodiment, a further transparent overlay sheet (not shown) may then be placed on top of sheet 18. Instead of the reversing process previously employed, the charting tapes 24 may be applied to the transparent film by holding the grid underlay magnetically.

Referring to FIG. 5, there is illustrated therein in cross-sectional view one embodiment according to the present invention. In this embodiment, there is employed the board 12, an underlay sheet 16, an overlay film 18, and retaining means 20. Underlay sheet 16 and overlay film 18 may be as above-described with overlay film 18 being of a transparent polyester material. Retaining means 20 comprises strips of magnetic material having on one face thereof a strong north magnetic pole 28 and a strong south magnetic pole 30 extending longitudinally of the strip. On the opposed face, there is provided a relatively weak south pole 32 opposed to strong north pole 28 and a relatively weak north pole 34 opposed to strong south pole 30. On the retaining means 20 also include polarity identifying means 37 along a side margin of the retaining strips 20. The polarity identifying means comprise a color-coated strip which, in this embodiment, is adapted to show the edge of the magnetic retaining means which has a strong north pole 28.

In FIG. 6, an alternative embodiment is shown wherein the board 12 is of a nonmagnetic material but employs a framing 36 of a ferromagnetic material. The retaining strips 20 comprise one longitudinally extending north pole 38 and one longitudinally extending south pole 40 with polarity identifying means 37 being proximate the north pole. FIG. 7 is similar to the embodiment illustrated in FIG. 6 except that board 12, while being of a non-magnetic material, includes a circumferentially extending insert 42 of a ferromagnetic material.

Referring to FIG. 8, board 12 is of a non-magnetic material and has an insert 27 extending circumferentially thereof. Insert 27 is of a permanently magnetic material having longitudinally extending north and south poles. In conjunction with the above, retaining of strips 20 are employed substantially as described with respect to FIG. 5.

In FIG. 9, board 12 comprises a laminate having a basic supporting layer of a nonmagnetic material such as masonite or the like with a ferromagnetic layer 44 adhesively secured thereto.

Referring to FIGS. 10 and 11, board 12 is formed of a ferromagnetic material and may include the embodiment illustrated, for example, in FIG. 9. The device further comprises the underlay sheet 16 and overlay film 18 retained in position by retaining means or strips 20. The retaining strips 20 may be those illustrated in either FIGS. 5 or 6. The device further includes a guiding marker indicated generally by reference numeral 46. Guiding marker 46 is preferably of dimensions similar to retaining strip 20 and comprises, on one face thereof, longitudinally extending strong north and south poles 54 and 56 respectively. On the other face thereof, there are provided relatively weak north and south poles 52 and 50 respectively opposed to the strong south and north poles. A guiding means 48 comprising a length of elastic material is secured to a pair of magnetic markers 46 and extends therebetween. As may be seen, markers 46 may be slid along retaining strips 20 to any desired position. Due to the polarity arrangement of both the retaining strips and the marker strips 46, the force with which the marker strips are held may be varied; they will always stay in alignment. These marker strips are extremely useful for graphs and the like.

Preferably, the retaining means and marker strips are formed of a resinous permanently magnetic material known to those skilled in the art.

It will be understood that the marking devices previously outlined may well be used in conjunction with the described devices and the device is eminently suitable for layout planning as previously discussed.

I claim:

1. A display system comprising a board of a substantially rectangular configuration having a pair of opposed major faces, a major portion of said board being formed of a nonmagnetic material, a minor portion of said board being of a ferromagnetic material, said ferromagnetic material extending circumferentially of said non-magnetic material on at least one of said major faces, at least said one major face being of a relatively flat and planar nature, at least one underlay sheet of a non-magnetic polyester material adapted to be placed in juxtaposition to said one major face, said underlay sheet being sized to extend to said ferromagnetic circumferential portion, at least one overlay film of a non-magnetic polyester adapted to be placed on top of said underlay sheet, said overlay film being sized to extend to said minor circumferential portion of a ferromagnetic material, said overlay film being of a relatively transparent material and being adapted to receive markings from a marking device, and retaining means, said retaining means comprising a plurality of pieces of permanently magnetic material, each of said pieces being of a flexible resinous material having a pair of spaced-apart north and south poles extending longitudinally thereof, each piece having polarity identifying means on one edge thereof, said magnetic retaining means adapted to retain said underlay sheet and said overlay film in juxtaposition to each other and to said one major face by cooperating in a magnetic manner with said ferromagnetic material forming the minor portion of said board, at least a pair of guiding markers, each of said guiding markers being of a permanently magnetic material of a rectangular configuration, each of said markers having a pair of longitudinally extending poles of major surfaces thereof, one surface having poles of a relatively weak nature and the other of the surfaces having poles of a relatively strong nature.

2. The system of claim 1 further including elastic guiding means extending between said pair of markers.

3. The system of claim 1 wherein said board comprises a laminated board having a thin layer of ferromagnetic material on one face thereof.

4. A display system comprising in combination a board of a substantially rectangular configuration having a pair of opposed major faces, a major portion of said board being formed of a non-magnetic material, a minor portion of said board being of a ferromagnetic material, said ferromagnetic material extending circumferentially of said non-magnetic material on at least one of said major faces, at least said one major face being of a relatively flat and planar nature, at least one underlay sheet of a non-magnetic polyester material adapted to be placed in juxtaposition to said one major face, said underlay sheet being sized to extend to said ferromagnetic circumferential portion, at least one overlay film of a non-magnetic polyester material adapted to be placed on top of said underlay sheet, said overlay film being sized to extend to said minor circumferential portion of a ferromagnetic material, said overlay film being of a relatively transparent material and being adapted to receive markings from any one or more of a plurality of marking devices, and retaining means comprised of a plurality of pieces of permanently magnetic material, said marking device comprising a first marking element capable of applying a dry erasable marker material to said overlay film, a second marking element capable of applying a liquid erasable marker material to said overlay film, and a third marking element capable of applying an organic element erasable marker material to said overlay film, such that the means for removing the different types of marker materials vary to permit removal of one or more of the marker materials without removal of the other, said first, second and third marking elements being erasable individually or in combination, said magnetic retaining means adapted to retain said underlay sheet and said overlay film in juxtaposition to each other and to said one major face by cooperating in a magnetic manner with said ferromagnetic material forming the minor portion of said board.

5. The display system of claim 4 wherein each of said retaining pieces are of a flexible resinous material having a pair of spaced apart north and south poles extending longitudinally thereof, each piece also having polarity identifying means on one edge thereof.

6. The system of claim 4 wherein said board comprises a laminated board having a thin layer of ferromagnetic material on one face thereof.

7. The display system of claim 4 wherein each of said retaining pieces being of a flexible resinous material and each of said pieces having a pair of opposed major faces, one of said faces having opposed spaced apart north and south magnetic poles extending longitudinally thereof, the other of said faces having opposed spaced apart north and south magnetic poles which are relatively strong compared to the magnetic poles on the first named face.

8. The display system of claim 7 wherein each of the pieces have polarity identifying means on one edge thereof.

9. The display system of claim 7 wherein the north pole and the south pole on one face is aligned with the south pole and the north pole, respectively, on the other face.

* * * * *